US010781824B2

(12) United States Patent
Hsieh et al.

(10) Patent No.: US 10,781,824 B2
(45) Date of Patent: Sep. 22, 2020

(54) FAN AND MOTOR

(71) Applicant: Delta Electronics, Inc., Taoyuan (TW)

(72) Inventors: Chi-Hao Hsieh, Taoyuan (TW); Jing-Han Lin, Taoyuan (TW); Chin-Sheng Liu, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 16/148,280

(22) Filed: Oct. 1, 2018

(65) Prior Publication Data

US 2019/0301484 A1 Oct. 3, 2019

(30) Foreign Application Priority Data

Apr. 3, 2018 (CN) ..... 2018 1 0296763

(51) Int. Cl.
*F04D 29/32* (2006.01)
*F04D 19/00* (2006.01)

(52) U.S. Cl.
CPC ..... *F04D 29/329* (2013.01); *F04D 19/002* (2013.01)

(58) Field of Classification Search
CPC .... F04D 29/325; F04D 29/329; F04D 19/002; F04D 29/26; F04D 29/32; F04D 19/048; F04D 25/002; F04D 25/022; F04D 27/008; F05B 2260/90; F05B 2260/902
See application file for complete search history.

(56) References Cited

U.S. PATENT DOCUMENTS

2018/0073514 A1* 3/2018 Zhang ..... F04D 27/008
2018/0231074 A1* 8/2018 Sun ..... F04D 19/002

* cited by examiner

*Primary Examiner* — Nathaniel E Wiehe
*Assistant Examiner* — Ryan C Clark
(74) *Attorney, Agent, or Firm* — Muncy, Geissler, Olds & Lowe, P.C.

(57) ABSTRACT

A fan and a motor are provided. The fan or the motor includes a shaft seat disposed on a frame, a rotor, and a stopping assembly. The rotor is disposed on the shaft seat and includes a hub and a rotation shaft. The hub has a first locking mechanism adjacent to its peripheral surface, and the rotor is connected to the shaft seat via the rotation shaft. The stopping assembly corresponds to the rotor, and includes a second locking mechanism facing the first mechanism. When the rotor smoothly rotates, the first locking mechanism is separated from the second locking mechanism. When the rotor rotates in reverse, the stopping assembly moves along a first direction, and the first and second locking mechanisms contact each other. When the first locking mechanism is affixed to the second locking mechanism, the rotor stops rotating.

16 Claims, 5 Drawing Sheets

A-A

FAN AND MOTOR

CROSS REFERENCE TO RELATED APPLICATIONS

This application claims the benefit of China Patent Application No. 201810296763.3, filed Apr. 3, 2018, the entirety of which is incorporated by reference herein.

BACKGROUND OF THE INVENTION

Field of the Invention

The application relates in general to a fan and a motor, and in particular, to a fan and a motor for preventing reverse rotation.

Description of the Related Art

If the temperature is not properly controlled when using an electronic device or a server, it may cause instability and other adverse effects on product reliability. Accordingly, the present electronic devices usually comprise fans as heat dissipation devices.

However, an electronic device or server of the type mentioned above usually has a plurality of fans. When one of the fans fails, the air introduced by other fans may cause the failed fan to rotate in reverse. Consequently, the introduced air may directly flow out from the electronic device or server through the failed fan, and the efficiency of heat dissipation is reduced. Thus, how to address the aforementioned problem has become an important issue.

BRIEF SUMMARY OF INVENTION

To address the deficiencies of conventional products, an embodiment of the invention provides a fan, including a shaft seat disposed on a frame, a rotor, a plurality of blades, and a stopping assembly. The rotor is disposed on the shaft seat and includes a hub and a rotation shaft. The hub has a first locking mechanism adjacent to its peripheral surface, the blades are connected to the hub, and the rotor is connected to the shaft seat via the rotation shaft. The stopping assembly corresponds to the rotor, and includes a second locking mechanism facing the first locking mechanism. When the rotor smoothly rotates, the first locking mechanism is separated from the second locking mechanism. When the rotor rotates in reverse, the stopping assembly moves along a first direction, and the first and second locking mechanisms contact each other. When the first locking mechanism is affixed to the second locking mechanism, the rotor stops rotating.

In some embodiments, the fan further comprises a rebounding assembly disposed between the hub and the stopping assembly. The rebounding assembly provides a pushing force to the stopping assembly along a second direction, wherein the second direction is opposite to the first direction. The rebounding assembly may comprise a first magnetic member and a second magnetic member corresponding to the first magnetic member, respectively disposed on the frame and the stopping assembly. The rebounding assembly can also comprise an elastic member, connected to the stopping assembly and the frame.

In some embodiments, the first locking mechanism comprises a plurality of toothed structures. Each of the toothed structures has a first contact surface and a second contact surface. The length or the appearance of the first contact surface is different from that of the second contact surface.

In some embodiments, the frame further comprises a base plate, and the stopping assembly comprises a bottom, a plurality of connecting members, and a locking portion. The connecting members pass through the base plate and connect the bottom and the locking portion, and the base plate is disposed between the bottom and the locking portion. A plurality of openings are formed on the base plate. The bottom has at least one extending structure, which is not parallel to the center surface of the bottom. The connecting members are inclined relative to the bottom and accommodated in the openings, and can move along a third direction in the openings, wherein the third direction is perpendicular to the first direction.

In some embodiments, the base plate, the connecting members, and the locking portion are integrally formed as one piece.

An embodiment of the invention further provides a motor, including a shaft seat disposed on a frame, a rotor, and a stopping assembly. The rotor is disposed on the shaft seat and includes a hub and a rotation shaft. The hub has a first locking mechanism adjacent to its peripheral surface, and the rotor is connected to the shaft seat via the rotation shaft. The stopping assembly corresponds to the rotor, and includes a second locking mechanism facing the first locking mechanism. When the rotor smoothly rotates, the first locking mechanism is separated from the second locking mechanism. When an external force is applied on the stopping assembly, the stopping assembly moves along a first direction, and the first and second locking mechanisms contact each other. When the first locking mechanism is affixed to the second locking mechanism, the rotor stops rotating.

BRIEF DESCRIPTION OF DRAWINGS

The invention can be more fully understood by reading the subsequent detailed description and examples with references made to the accompanying drawings, wherein.

DETAILED DESCRIPTION OF INVENTION

The making and using of the embodiments of the fan and motor are discussed in detail below. It should be appreciated, however, that the embodiments provide many applicable inventive concepts that can be embodied in a wide variety of specific contexts. The specific embodiments discussed are merely illustrative of specific ways to make and use the embodiments, and do not limit the scope of the disclosure.

Unless defined otherwise, all technical and scientific terms used herein have the same meaning as commonly understood by one of ordinary skill in the art to which this invention belongs. It should be appreciated that each term, which is defined in a commonly used dictionary, should be interpreted as having a meaning conforming to the relative skills and the background or the context of the present disclosure, and should not be interpreted in an idealized or overly formal manner unless defined otherwise.

Figure 1:
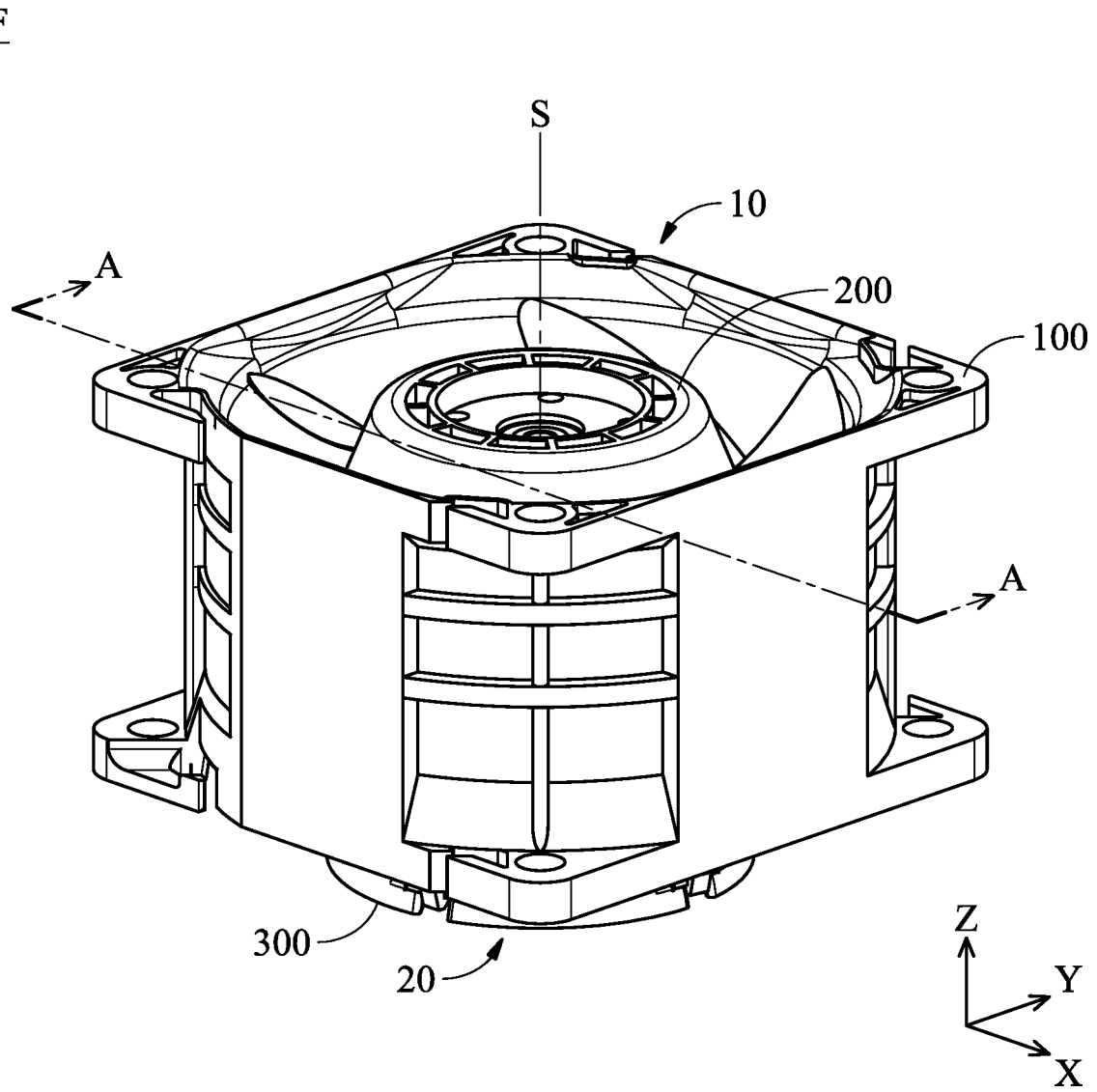
FIG. 1 is a schematic diagram of a fan according to an embodiment of the invention.
Figure 2A:
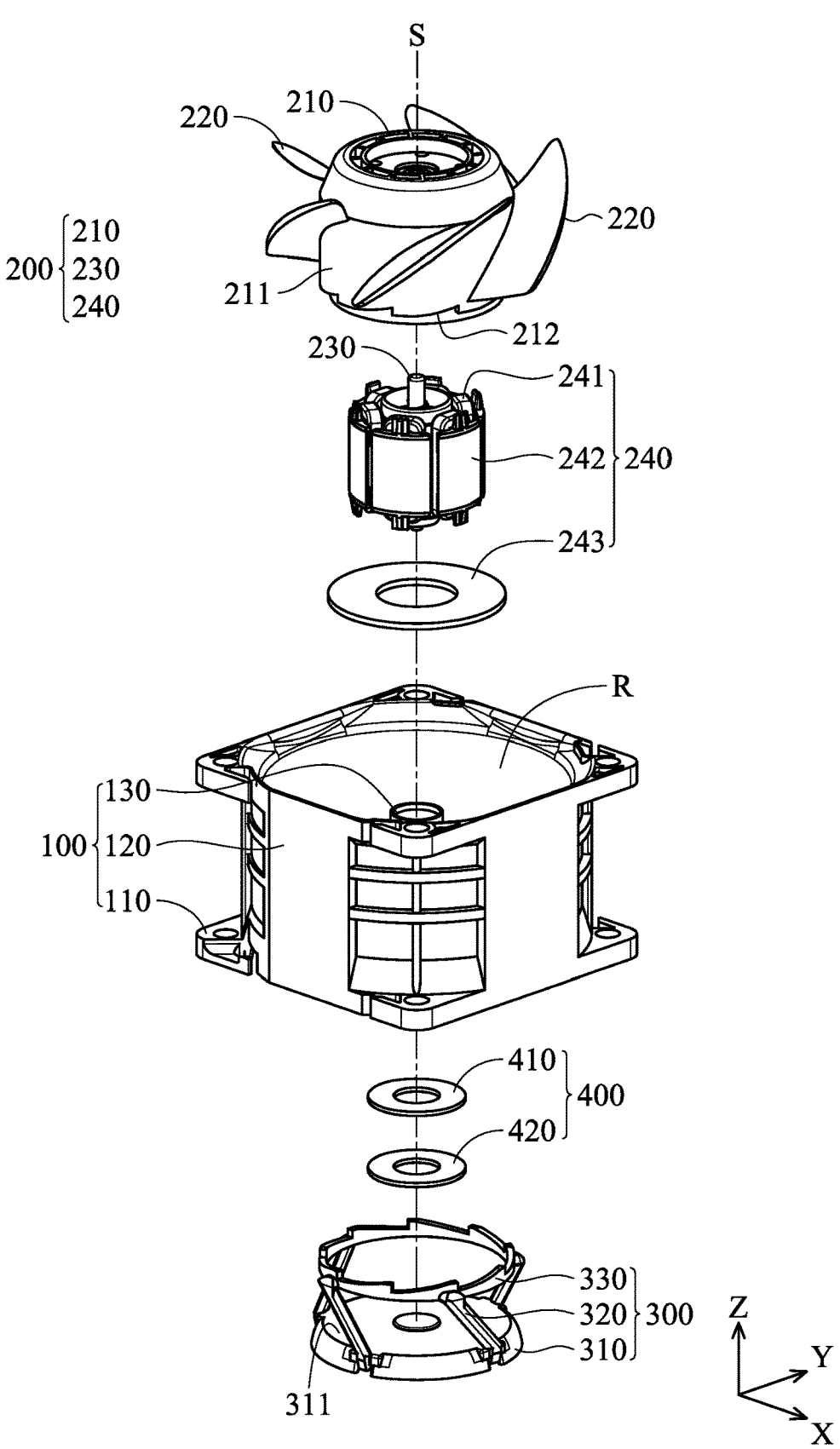
FIG. 2A is an exploded-view diagram of the fan according to an embodiment of the invention.
Figure 2B:
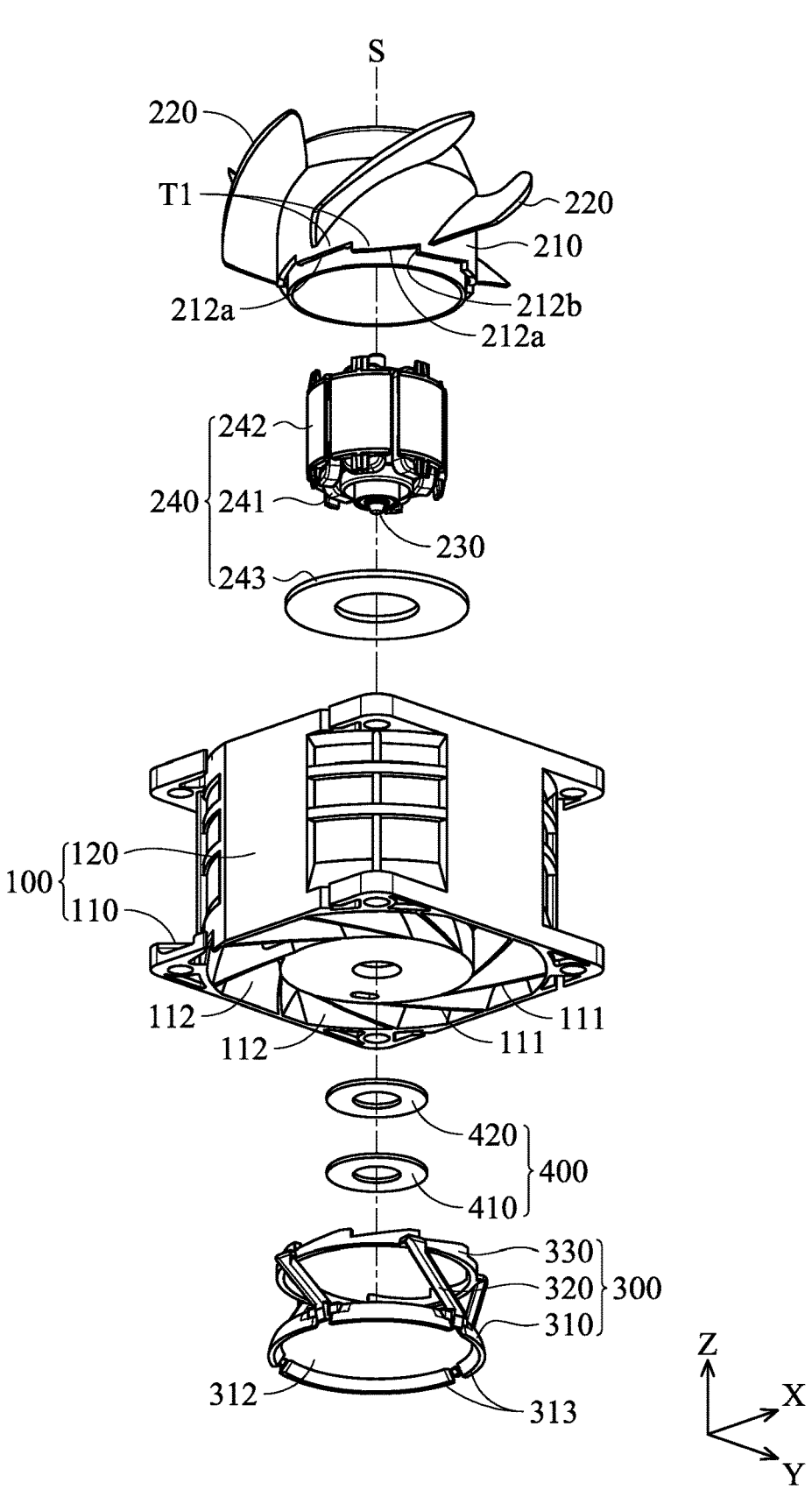
FIG. 2B is another exploded-view diagram of the fan according to an embodiment of the invention.

FIG. 1 is a schematic diagram of a fan F according to an embodiment of the invention, and FIGS. 2A and 2B are exploded-view diagrams of the aforementioned fan F. Referring to FIGS. 1, 2A and 2B, the fan F primarily comprises a frame 100, a motor, and a plurality of blades 220, wherein the motor comprises a rotor 200, a stopping assembly 300, and a rebounding assembly 400. When the fan F operates, the rotor 200 of the fan F can rotate around a rotation axis S, and the air can flow from the air-intake side 10 of the fan F to the exhaust side 20 of the fan F. Generally, the fan F can be disposed in a server or an electronic device (such as a personal computer), so as to introduce the external air into the server or the electronic device, or exhaust therefrom. Therefore, the purpose of heat dissipation can be achieved.

As shown in FIGS. 2A and 2B, the frame 100 comprises a base plate 110 and a side wall 120. The side wall 120 is connected to the base plate 110 and surrounds an accommodating space R. In particular, the base plate 110 has a plurality of ribs 111, and can be connected to the side wall 120 through the ribs 111. A plurality of openings 112 can be formed between the ribs 111. The rotor 200 can introduce or exhaust the external air through the openings 112. Furthermore, a shaft seat 130 is disposed on the base plate 110 of the frame 100.

Referring to FIGS. 2A and 2B, in this embodiment, the rotor 200 may comprise a hub 210, a rotation shaft 230, and a driving module 240. The hub 210 is hollow, and the rotation shaft 230 and the driving module 240 can be accommodated in the hub 210. The blades 220 are connected to the peripheral surface 211 of the hub 210 at equal intervals.

In this embodiment, a first locking mechanism 212 is formed on the bottom of hub 210 adjacent to the peripheral surface 211, wherein the first locking mechanism 212 comprises a plurality of toothed structures T1. Each of the toothed structures T1 has a first contact surface 212*a* and a second contact surface 212*b*, and the second contact surface 212*b* is connected to the first contact surface 212*a* of the adjacent toothed structure T1. It should be noted that, the length or the appearance of the first contact surface 212*a* is different from that of the second contact surface 212*b*. For example, in this embodiment, the length of the first contact surface 212*a* is greater than that of the second contact surface 212*b*, and the second contact surface 212*b* is substantially parallel to the rotation axis S. Each of the toothed structures T1 is substantially formed as a right triangle.

The rotation shaft 230 can connect the hub 210 of the rotor 200 to the shaft seat 130, and the driving module 240 can drive the hub 210 and the blades 220 to rotate around the rotation axis S relative to the frame 100. For example, the driving module may comprise at least one driving coil 241, at least one magnetic member 242, and at least one circuit board 243. The driving coil 241 and the magnetic member 242 are respectively disposed on the shaft seat 230 and the hub 210, and the circuit board 243 is disposed on the base plate 110 and electrically connected to the driving coil 241. When a current flows through the driving coil 241 via the circuit board 243, an electromagnetic force is generated between the driving coil 241 and the magnetic member 242. Therefore, the hub 210 and the blades 220 can rotate around the rotation axis S relative to the frame 100. Since the rotation shaft 230 is inserted into the shaft seat 130, the hub 210 and the blades 220 will not deviate from the rotation axis S during rotation.

Figure 3:
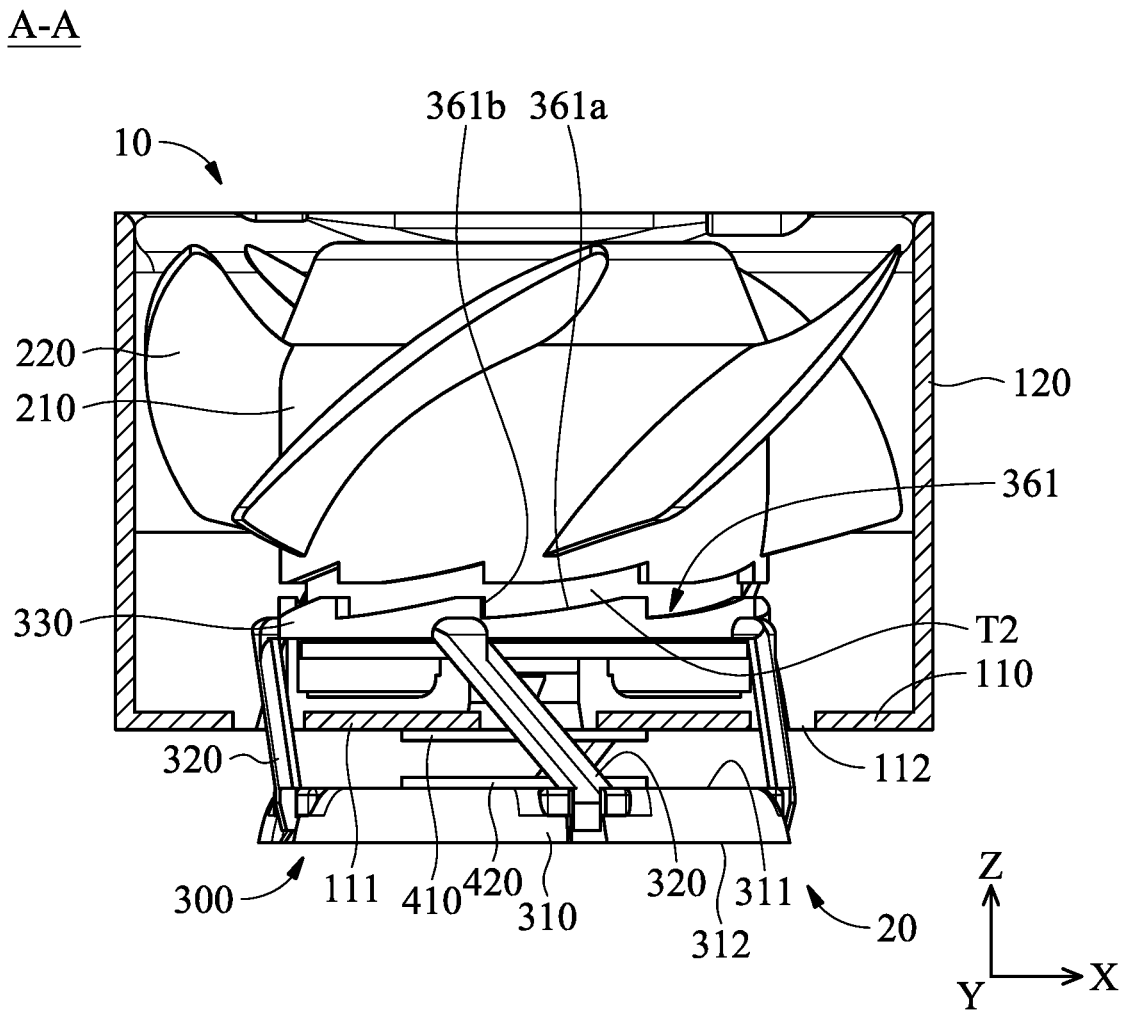
FIG. 3 is a cross-sectional view along the line A-A in FIG. 1.

FIG. 3 is a cross-sectional view along the line A-A in FIG. 1. As shown in FIGS. 2A, 2B, and 3, the stopping assembly 300 comprises a bottom 310, a plurality of connecting members 320, and a locking portion 330. The bottom 310 has a first surface 311 and a second surface 312, wherein the first surface 311 is opposite to the second surface 312 and faces the hub 210. Moreover, in this embodiment, the bottom 310 further comprises at least one extending structure 313, which is not parallel to the center surface of the bottom 310.

The base plate 110 is disposed between the bottom 310 and the locking portion 330, and the connecting members 320 pass through the openings 112 on the base plate 110 to connect the bottom 310 to the locking portion 330. In this embodiment, the connecting members 320 are disposed to correspond the rotation direction of the hub 210, therefore, the connecting members 320 are inclined relative to the bottom 310 of the stopping assembly 300. The ribs 111 on the base plate 110 correspond to the connecting members 320 of the stopping assembly 300, so they are also inclined. Furthermore, the width of each of the openings 112 is greater than that of each of the connecting members 320. Thus, the connecting members 320 can move along X-axis or Y-axis in the openings 112.

A second locking mechanism 361 corresponding to the first locking mechanism 212 is formed on the locking portion 330, and comprises a plurality of fasten recesses T2. Each of the fasten recesses T2 has a third contact surface 361*a* and a fourth contact surface 361*b*, and the fourth contact surface 361*b* is connected to the third contact surface 361*a* of the adjacent fasten recess T2. The third contact surface 361*a* and the fourth contact surface 361*b* respectively correspond to the first contact surface 212*a* and the second contact surface 212*b*. In this embodiment, the length of the third contact surface 361*a* is substantially the same as that of the first contact surface 212*a*. The fourth contact surface 361*b* is parallel to the rotation axis S, and its length is substantially the same as the length of the second contact surface 212*b*. The included angle between the third contact surface 361*a* and the fourth contact surface 361*b* is substantially the same as that between the first contact surface 212*a* and the second contact surface 212*b*.

In this embodiment, the bottom 310, the connecting members 320, and the locking portion 330 are formed in an assembled manner, so as to facilitate the assembly. In some embodiment, the bottom 310, the connecting members 320, and the locking portion 330 can be integrally formed as one piece.

Referring to FIGS. 2A, 2B, and 3, the rebounding assembly 400 is disposed between the hub 210 and the stopping assembly 300, and provides a pushing force away from the hub 210 on the first surface 311 of the bottom 310. In this embodiment, the rebounding assembly 400 comprises a first magnetic member 410 and a second magnetic member 420, respectively affixed to the base plate 110 and the first surface 311 of the bottom 310. The surfaces of the first and second magnetic members 410 and 420 facing each other include the same magnetic pole. Therefore, the aforementioned pushing force can be provided by the magnetic repulsion force between the first magnetic member 410 and the second magnetic member 420.

In some embodiments, the rebounding assembly 400 may comprise an elastic member (not shown) connected to the base plate 110 and the first surface 311, such as a compression spring. The aforementioned pushing force can be provided by the elastic force of the elastic member.

The operation method of the fan F is discussed below. Referring to FIG. 3, when the driving module 240 operates normally and the rotor 200 smoothly rotates, the air flows from the air-intake side 10 of the fan F to the exhaust side 20 of the fan F. At this time, the hub 210 is separated from the stopping assembly 300, and the stopping assembly 300 is affixed to a first position relative to the hub 210 due to the pushing force of the rebounding assembly 400. The stopping assembly 300 does not move close to the hub 210 when shaking or colliding.

Figure 4:
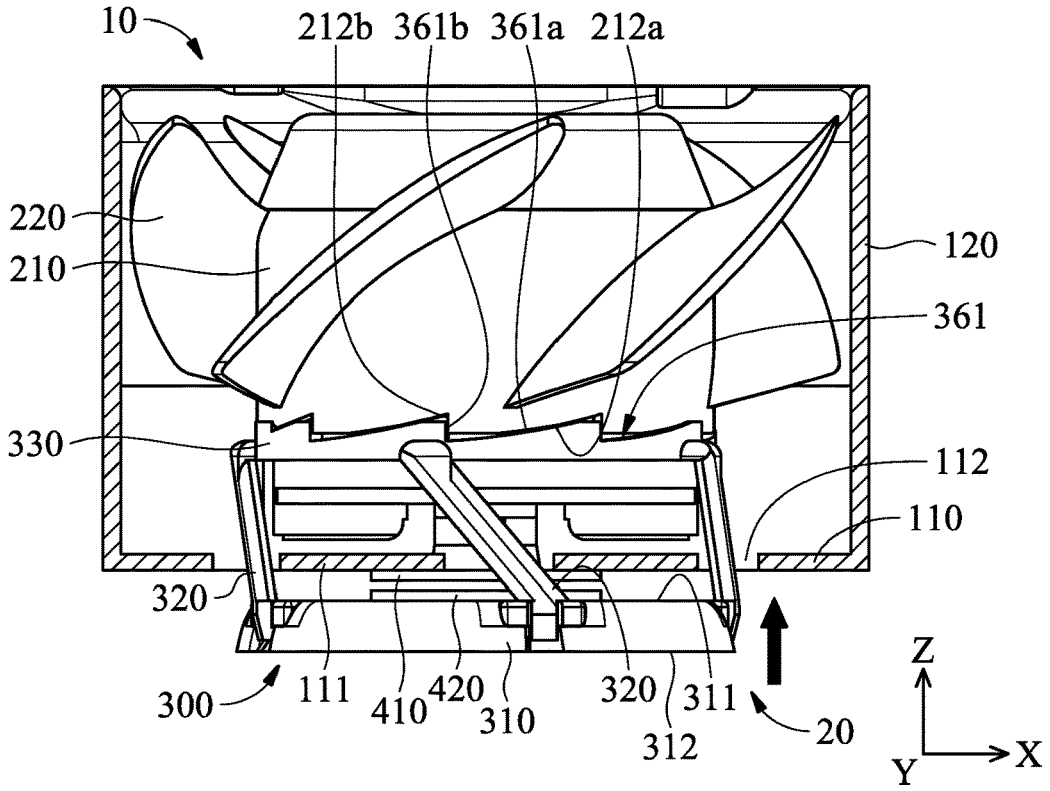
FIG. 4 is a schematic diagram representing a first locking mechanism affixing to a second locking mechanism according to an embodiment of the invention.

When the fan F fails and cannot operate normally (for example, due to the failure of the driving module 240, or interference between a foreign object and the blades 220), the fan F cannot introduce air to flow from the air-intake side 10 to the exhaust side 20. Moreover, air may flow from the exhaust side 20 to the air-intake side 10 when this fan F is disposed in some external environment, and the rotor 200 may rotate in reverse. As shown in FIG. 4, when the air flows from the exhaust side 20 to the air-intake side 10 and the rotor 200 rotates in reverse, the air can apply an external force that is greater than the pushing force of the rebounding assembly 400 on the second surface 312 of the bottom 310. The stopping assembly 300 moves along the Z-axis (the first direction) from the first position to a second position, and the first locking mechanism 212 contacts the second locking mechanism 361. When the first locking mechanism 212 is affixed to the second locking mechanism 361, the rotor 200 stops rotating.

In detail, when the first locking mechanism 212 is affixed to the second locking mechanism 361, the first contact surface 212*a* contacts the third contact surface 361*a*, and the second contact surface 212*b* contacts the fourth contact surface 361*b*. Since the second and fourth contact surfaces 212*b* and 361*b* are substantially parallel to the rotation axis S, the rotor 200 cannot rotate in reverse, and stops rotating.

Since the connecting members 320 can move along X-axis or Y-axis (the third direction) in the openings 112 in a certain range, the second locking mechanism 361 can be easily joined with the first locking mechanism 212, so as to reduce the worn therebetween caused by the friction.

Figure 5:
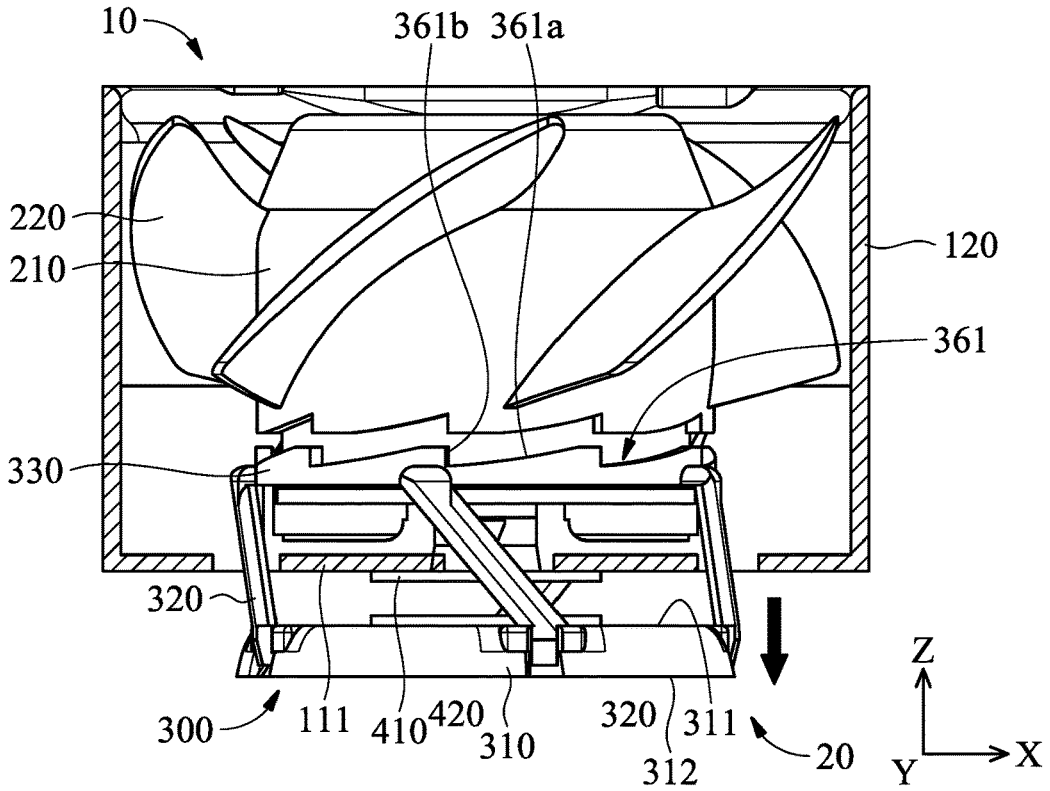
FIG. 5 is a schematic diagram representing the first locking mechanism separated from the second locking mechanism according to an embodiment of the invention.

Referring to FIG. 5, when the failure is resolved and the fan F operates normally again, the rotor 200 smoothly rotates again, and the first contact surface 212*a* slides along the third contact surface 361*a* and pushes the stopping assembly 300 to move along −Z-axis (the second direction). Therefore, the first locking mechanism 212 is separated from the second locking mechanism 361. Furthermore, since the fan F introduces the air to flow from the air-intake side 10 to the exhaust side 20 again, the external force from the air is not applied on the second surface 312 of the bottom 310, and the pushing force of the rebounding assembly 310 can drive the stopping assembly 300 to move along −Z-axis (the second direction) to the first position.

In other words, when the external force applied on the second surface 312 of the bottom 310 of the stopping assembly 300 is less than the pushing force applied on the first surface 311 of the bottom 310 from the rebounding assembly 400, the stopping assembly 300 is in the first position relative to the rotor 200, and the first locking mechanism 212 is separated from the second locking mechanism 361. When the external force applied on the second surface 312 of the bottom 310 of the stopping assembly 300 is greater than the pushing force applied on the first surface 311 of the bottom 310 from the rebounding assembly 400, the stopping assembly 300 can move from the first position to the second position relative to the rotor 200, and the first locking mechanism 212 is affixed to the second locking mechanism 361.

Furthermore, since the first locking mechanism 212 is formed on the hub 210 adjacent to the peripheral surface 211, the contact area of the first locking mechanism 212 and the second locking mechanism 361 can be increased, and the manufacture of the members is also facilitated.

In summary, a fan and a motor are provided. The fan or the motor includes a shaft seat disposed on a frame, a rotor, and a stopping assembly. The rotor is disposed on the shaft seat and includes a hub and a rotation shaft. The hub has a first locking mechanism adjacent to its peripheral surface, and the rotor is connected to the shaft seat via the rotation shaft. The stopping assembly corresponds to the rotor, and includes a second locking mechanism facing the first locking mechanism. When the rotor smoothly rotates, the first locking mechanism is separated from the second locking mechanism. When the rotor rotates in reverse, the stopping assembly moves along a first direction, and the first and second locking mechanisms contact each other. When the first locking mechanism is affixed to the second locking mechanism, the rotor stops rotating.

Although some embodiments of the present disclosure and their advantages have been described in detail, it should be understood that various changes, substitutions and alterations can be made herein without departing from the spirit and scope of the disclosure as defined by the appended claims. For example, it will be readily understood by those skilled in the art that many of the features, functions, processes, and materials described herein may be varied while remaining within the scope of the present disclosure. Moreover, the scope of the present application is not intended to be limited to the particular embodiments of the process, machine, manufacture, compositions of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps. Moreover, the scope of the appended claims should be accorded the broadest interpretation so as to encompass all such modifications and similar arrangements.

While the invention has been described by way of example and in terms of preferred embodiment, it should be understood that the invention is not limited thereto. On the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. A fan, comprising:

a shaft seat, disposed on a frame;

a rotor, disposed on the shaft seat, comprising:

a hub, having a first locking mechanism integrally formed on a peripheral surface of the hub; and a rotation shaft, wherein the rotor is connected to the shaft seat via the rotation shaft;

a plurality of blades, connected to the hub;

a stopping assembly, corresponding to the rotor and having a second locking mechanism, wherein the second locking mechanism faces and corresponds to the first locking mechanism; and a rebounding assembly, disposed between the hub and the stopping assembly, and provides a pushing force on the stopping assembly along a second direction to separate the first locking mechanism from the second locking mechanism, wherein when the rotor smoothly rotates, the first locking mechanism is separated from the second locking mechanism by pushing force of the rebounding assembly, and when the fan fails and an air flows from an exhaust side to an air-intake side of the fan so that the rotor rotates in reverse, an external force greater than the pushing force is applied on the stopping assembly along a first direction opposite to the second direction, the stopping assembly moves along the first direction, and the first locking mechanism and the second locking mechanism contact each other, wherein when the first locking is affixed to the second locking mechanism, the rotor stops rotating.

2. The fan as claimed in claim 1, wherein the rebounding assembly comprises:

a first magnetic member, disposed on the frame; and a second magnetic member, disposed on the stopping assembly and corresponding to the first magnetic member.

3. The fan as claimed in claim 1, wherein the first locking mechanism comprises a plurality of toothed structures.

4. The fan as claimed in claim 3, wherein each of the toothed structures has a first contact surface and a second contact surface, and the length or appearance of the first contact surface is different from that of the second contact surface.

5. The fan as claimed in claim 1, wherein the frame further comprises a base plate, and the stopping assembly comprises a bottom, a plurality of connecting members, and a locking portion, wherein the connecting members pass through the base plate and connect the bottom to the locking portion, and the base plate is disposed between the bottom and the locking portion.

6. The fan as claimed in claim 5, wherein the base plate has a plurality of openings, the connecting members are accommodated in the openings and can move along a third direction in the openings, wherein the third direction is different from the first direction.

7. The fan as claimed in claim 5, wherein the connecting members are inclined relative to the bottom.

8. The fan as claimed in claim 5, wherein the bottom has an extending structure, which is not parallel to the center surface of the bottom.

9. A motor, comprising:

a shaft seat, disposed on a frame;

a rotor, disposed on the shaft seat, comprising:

a hub, having a first locking mechanism integrally formed on a peripheral surface of the hub; and a rotation shaft, wherein the rotor is connected to the shaft seat via the rotation shaft;

a stopping assembly, corresponding to the rotor and having a second locking mechanism, wherein the second locking mechanism faces the first locking mechanism; and a rebounding assembly, disposed between the hub and the stopping assembly, and provides a pushing force on the stopping assembly along a second direction to separate the first locking mechanism from the second locking mechanism, wherein when the rotor smoothly rotates, the first locking mechanism is separated from the second locking mechanism by pushing force of the rebounding assembly, and when the motor fails and an air flows from an exhaust side to an air-intake side of the motor, an external force greater than the pushing force is applied on the stopping assembly along a first direction opposite to the second direction, the stopping assembly moves along the first direction, and the first locking mechanism and second locking mechanism contact each other, wherein when the first locking mechanism is affixed to the second locking mechanism, the rotor stops rotating.

10. The motor as claimed in claim 9, wherein the rebounding assembly comprises:

a first magnetic member, disposed on the frame; and a second magnetic member, disposed on the stopping assembly and corresponding to the first magnetic member.

11. The motor as claimed in claim 9, wherein the first locking mechanism comprises a plurality of toothed structures.

12. The motor as claimed in claim 11, wherein each of the toothed structures has a first contact surface and a second contact surface, and the length or the appearance of the first contact surface is different from that of the second contact surface.

13. The motor as claimed in claim 9, wherein the frame further comprises a base plate, and the stopping assembly comprises a bottom, a plurality of connecting members, and a locking portion, wherein the connecting members pass through the base plate and connect the bottom to the locking portion, and the base plate is disposed between the bottom and the locking portion.

14. The motor as claimed in claim 13, wherein the base plate has a plurality of openings, the connecting members are accommodated in the openings and can move along a third direction in the openings, wherein the third direction is different from the first direction.

15. The motor as claimed in claim 13, wherein the connecting members are inclined relative to the bottom.

16. The motor as claimed in claim 13, wherein the bottom has an extending structure, which is not parallel to the center surface of the bottom.

* * * * *